US010113755B2

(12) United States Patent
Nezu et al.

(10) Patent No.: US 10,113,755 B2
(45) Date of Patent: Oct. 30, 2018

(54) OUTDOOR UNIT OF AIR CONDITIONER

(71) Applicant: FUJITSU GENERAL LIMITED, Kawasaki-shi, Kanagawa-ken (JP)

(72) Inventors: Kenta Nezu, Kawasaki-shi (JP); Satoshi Kasugai, Kawasaki-shi (JP)

(73) Assignee: FUJITSU GENERAL LIMITED, Kawasaki-Shi, Kanagawa-Ken (JP)

( * ) Notice: Subject to any disclaimer, the term of this patent is extended or adjusted under 35 U.S.C. 154(b) by 0 days.

(21) Appl. No.: 15/423,164

(22) Filed: Feb. 2, 2017

(65) Prior Publication Data

US 2017/0248327 A1 Aug. 31, 2017

(30) Foreign Application Priority Data

Feb. 29, 2016 (JP) ..... 2016-037419

(51) Int. Cl.

| | |
|---|---|
| ***F24F 1/18*** | (2011.01) |
| ***F24F 1/06*** | (2011.01) |
| ***F24F 1/46*** | (2011.01) |
| ***F24F 1/48*** | (2011.01) |
| ***F24F 13/20*** | (2006.01) |

(52) U.S. Cl.

CPC ..... *F24F 1/18* (2013.01); *F24F 1/06* (2013.01); *F24F 1/46* (2013.01); *F24F 1/48* (2013.01); *F24F 13/20* (2013.01)

(58) Field of Classification Search

CPC ..... F24F 1/06; F24F 1/18; F24F 1/46; F24F 1/48; F24F 13/20

See application file for complete search history.

(56) References Cited

U.S. PATENT DOCUMENTS

2015/0271949 A1* 9/2015 Kim ..... H05K 7/20272 361/699
2016/0054011 A1* 2/2016 Katayama ..... F24F 1/38 415/175

FOREIGN PATENT DOCUMENTS

JP 3710874 B2 10/2005
JP 2008138951 A * 6/2008

OTHER PUBLICATIONS

JP 2008138951 A translation.*

* cited by examiner

*Primary Examiner* — Elizabeth Martin
(74) *Attorney, Agent, or Firm* — Manabu Kanesaka

(57) ABSTRACT

Provided is an outdoor unit of an air conditioner capable of obtaining efficient air blowing performance by optimizing a length dimension of a heat exchanger and a relative position of a blower. A front end portion is disposed closer to the left side panel than a rotation shaft of the first blower, and a rear end portion is disposed closer to the right side panel than a rotation shaft of the first blower in the first heat exchanger, and a front end portion is disposed closer to the right side panel than a rotation shaft of the second blower, and a rear end portion is disposed closer to the left side panel than a rotation shaft of the second blower in the second heat exchanger.

5 Claims, 5 Drawing Sheets

OUTDOOR UNIT OF AIR CONDITIONER

RELATED APPLICATIONS

The present application is based on, and claims priority from, Japanese Application No. JP2016-037419 filed Feb. 29, 2016, the disclosure of which is hereby incorporated by reference herein in its entirety.

BACKGROUND OF THE INVENTION

1. Field of the Invention

The present invention relates to an outdoor unit of an air conditioner, more specifically, to an outdoor unit of an air conditioner in which a blower chamber is disposed above a machine chamber having a heat exchanger and a compressor.

2. Description of Related Art

As one of an air conditioner, there is a multi-type air conditioner in which a plurality of indoor units are connected to one outdoor unit. For example, as described in Japanese Patent No. 3710874, the outdoor unit of the air conditioner includes a horizontally elongated rectangular parallelepiped housing, and the interior of the housing is partitioned into a machine chamber having a heat exchanger and a compressor, and a blower chamber having a blower. The machine chamber is disposed in the lower portion of the housing, the blower chamber is disposed in the upper portion of the machine chamber, and the air blowing port of the blower is disposed on the top surface of the housing.

When viewed a lateral direction of the housing from front, a left half space of the machine chamber is defined as a left machine chamber, a right half space of the machine chamber is defined as a right machine chamber, the left half space of the blower chamber is defined as a left blower chamber, and the left half space of the blower chamber is defined as a right blower chamber, a first heat exchanger is disposed in the left machine chamber, a second heat exchanger is disposed in the right machine chamber, a first blower is disposed in the left blower chamber, and a second blower is disposed in the right blower chamber.

In Japanese Patent No. 3710874, both the first and the second heat exchangers are formed in a U-shape, open ends thereof are disposed so as to face each other, and the compressor is disposed so as to be surrounded by the heat exchanger.

Rear end sides of the first and the second heat exchanger (rear surface side in FIG. 2 in Japanese Patent No. 3710874) are disposed to a position close to each other, and front end sides (front surface side in FIG. 1 in Japanese Patent No. 3710874) are disposed with a predetermined interval so as to leave a front opening portion for maintenance.

According to this configuration, since the capacity of the heat exchanger can be enlarged as large as possible except for the front opening portion for maintenance, it is considered that heat exchange efficiency is further enhanced. However, in a case of arranging so as to surround the heat exchanger centering on the blower, the wind does not pass evenly through the heat exchanger, is respectively dispersed in a rear portion, a side portion, and a front portion, and variations occur. Therefore, a portion of the wind is wasted without being able to sufficiently exhibit possible performance of the blower. As a result, there is a possibility that heat exchange efficiency decreases.

SUMMARY OF THE INVENTION

Therefore, an object of the present invention is to provide an outdoor unit of an air conditioner capable of obtaining stable air blowing performance by optimizing a length dimension of a heat exchanger and a relative position of a blower and effectively utilizing wind of the blower that is conventionally wasted.

An outdoor unit of an air conditioner according to an aspect of the present invention includes a housing that includes a base panel, a left side panel that is vertically disposed at a left side end of the base panel, a right side panel that is vertically disposed at a right side end of the base panel, and a front beam and a rear beam that are respectively hung between a front end and a rear end of the left side panel and the right side panel. An interior of the housing is partitioned into a machine chamber having a heat exchanger and a compressor at a lower portion and a blower chamber having a blower at an upper portion, with a plane including the front beam and the rear beam as a boundary. A first blower and a second blower are supported side by side by the front beam and the rear beam in the blower chamber, a first heat exchanger and a second heat exchanger formed in a U-shape are disposed in the machine chamber so that end portions thereof face each other. A lower space on the first blower side is defined as a left machine chamber and a lower space on the second blower side is defined as a right machine chamber among the machine chambers, the first heat exchanger is disposed in the left machine chamber, the second heat exchanger is arranged in the right machine chamber, and a first air blowing port of the first blower and a second air blowing port of the second blower are disposed on the top surface of the housing. A front end portion is disposed closer to the left side panel than a rotation shaft of the first blower, and a rear end portion is disposed closer to the right side panel than a rotation shaft of the first blower in the first heat exchanger. A front end portion is disposed closer to the right side panel than a rotation shaft of the second blower, and a rear end portion is disposed closer to the left side panel than a rotation shaft of the second blower in the second heat exchanger.

As another preferred aspect, when a first virtual line passing through the axis of the rotation shaft of the first blower and orthogonal to the front surface of the housing is defined as LL, a second virtual line passing through the axis of the rotation shaft of the second blower and orthogonal to the front surface of the housing is defined as LR, a distance between the first virtual line LL and the rear end portion of the first heat exchanger is defined as BL, a distance between the second virtual line LR and the rear end portion of the second heat exchanger is defined as BR, a distance between the first virtual line LL and the front end portion of the first heat exchanger is defined as AL, and a distance between the second virtual line LR and the front end portion of the second heat exchanger is defined as AR, the distance AL of the front end portion of the first heat exchanger satisfies $0.4\times BL$ or more and $0.5\times BL$ or less ($0.4\ BL \leq AL \leq 0.5\ BL$), and the distance AR of the front end portion of the second heat exchanger satisfies $0.4\times BR$ or more and $0.5\times BR$ or less ($0.4\ BR \leq AR \leq 0.5\ BR$).

As still another preferred aspect, it is preferable that the first heat exchanger and the second heat exchanger are symmetrically disposed with the center of the housing being interposed therebetween.

As still another preferred aspect, it is preferable that the first blower and the second blower are symmetrically disposed with the center of the housing being interposed therebetween.

According to the aspect of the present invention, the front end portion of the first heat exchanger is disposed closer to the left side than the rotation shaft of the first blower, the rear end portion thereof is disposed closer to the right side than the rotation shaft of the first blower, and the front end portion of the second heat exchanger is disposed closer to the right side than the rotation shaft of the second blower and the rear end portion thereof is disposed closer to the left side of the rotation shaft of the second blower. Therefore, the relative arrangement of the heat exchanger and the blower is optimized, and it is possible to effectively utilize the wind of the blower which is conventionally wasted. As a result, since the amount of air and the wind velocity distribution per unit area passing through the heat exchanger at the same rotation speed increase, the rotation speed (current consumption) of the motor for obtaining the same amount of air is reduced.

DESCRIPTION OF EMBODIMENTS

Next, although embodiments of an outdoor unit of an air conditioner of the present invention will be described with reference to drawings, the present invention is not limited thereto.

Figure 1:
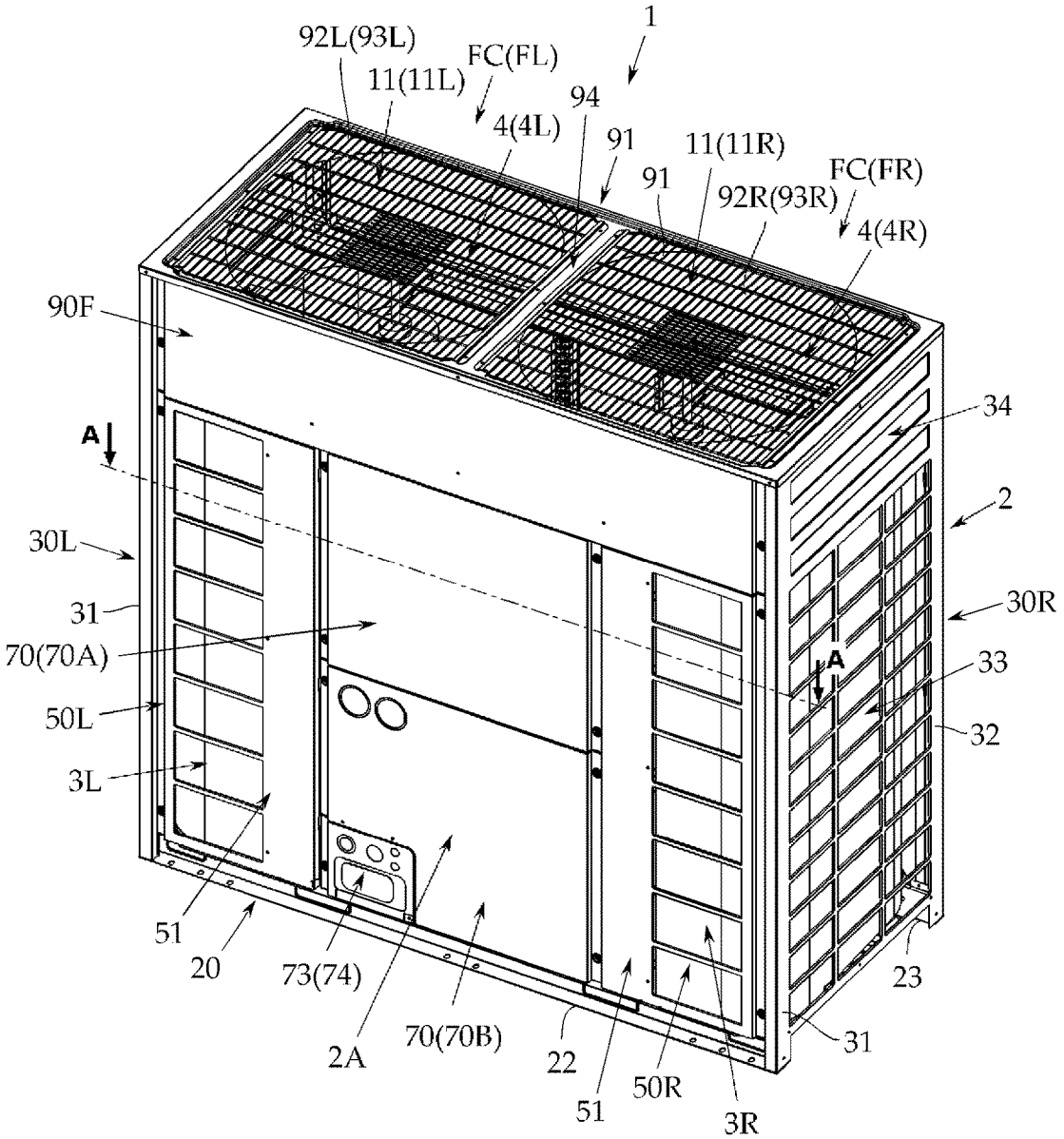
FIG. 1 is an external perspective view of a front surface side of an outdoor unit of an air conditioner according to an embodiment of the present invention.

As illustrated in FIGS. 1 to 4, an outdoor unit 1 of an air conditioner includes a rectangular parallelepiped housing 2 horizontally elongated in a lateral direction (lateral direction in FIG. 1). An interior of the housing 2 is partitioned into a machine chamber MC having a heat exchanger 3 and a compressor (not illustrated), and a blower chamber FC having a blower 4. In the embodiment, the machine chamber MC is disposed at a lower portion in the housing 2, and the blower chamber FC is disposed on an upper portion of the machine chamber MC.

When viewing the lateral direction of the housing 2 in front surface in FIG. 1, a left half space of the machine chamber MC is defined as a left machine chamber ML, a right half space thereof is defined as a right machine chamber MR, a left half space of the blower chamber FC is defined as a left blower chamber FL, and a right half space of the blower chamber FC is defined as a right blower chamber FR. A first heat exchanger 3L is disposed in the left machine chamber ML of the housing 2, and a second heat exchanger 3R is disposed in the right machine chamber MR.

In addition, a first blower 4L is disposed in the left blower chamber FL, a second blower 4R is disposed in the right blower chamber FR, and a first air blowing port 11L of the first blower 4L and a second air blowing port 11R of the second blower 4R are respectively disposed on an upper surface of the housing 2.

The housing 2 is provided with a rectangular base panel 20 installed on the surface to be installed, a left side panel 30L vertically disposed at a left side end of the base panel 20, a right side panel 30R vertically disposed at a right side end of the base panel 20, a front beam 40F (refer to FIG. 4) hung horizontally between a front end of the left side panel 30L and a front end of the right side panel 30R, and a rear beam 40R (refer to FIG. 4) hung horizontally between a rear end of the left side panel 30L and a rear end of the right side panel 30R, as a basic structure.

Figure 4:
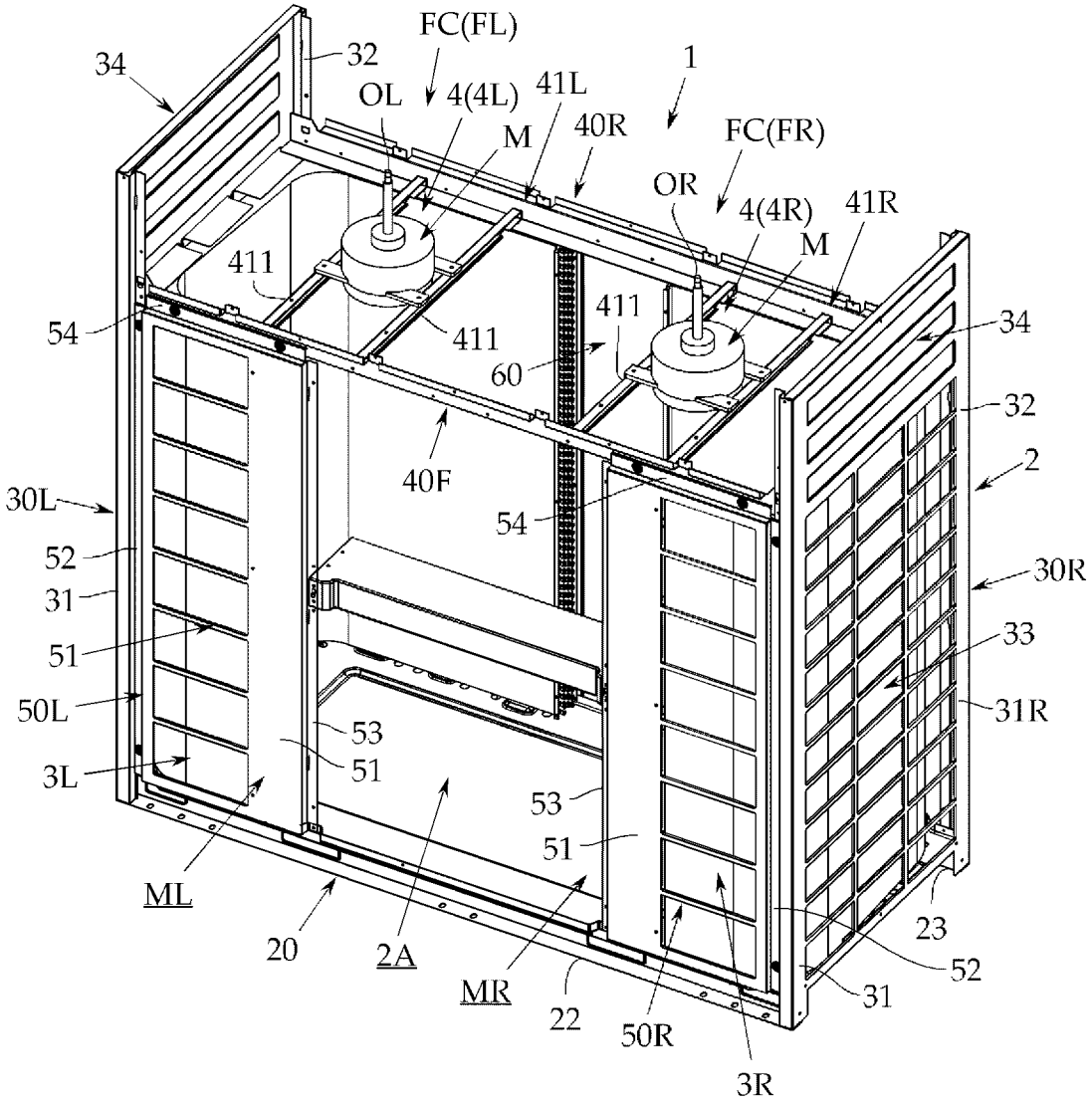
FIG. 4 is an external perspective view of a front surface side of a front pillar attached to a base panel, a front beam, and a side panel.

As illustrated in FIG. 4, the base panel 20 is formed by pressing or welding a steel plate, and is formed in a horizontally elongated rectangular shape. An engagement portion not illustrated in which a panel is screwed to the circumferential edge of the base panel 20 is substantially vertically disposed over the entire circumference.

On the base panel 20, a front leg 22 and a rear leg 23 are formed when the outdoor unit 1 is installed on the surface to be installed (not illustrated). The front leg 22 is bent substantially at right angle from a front end side (front side in FIG. 4) toward the lower side of the base panel 20, and is formed continuously over the right and left. The rear leg 23 is bent substantially at right angle from a rear end side (rear side in FIG. 4) toward the lower side of the base panel 20, and is formed continuously over both the right and left ends.

Figure 3:
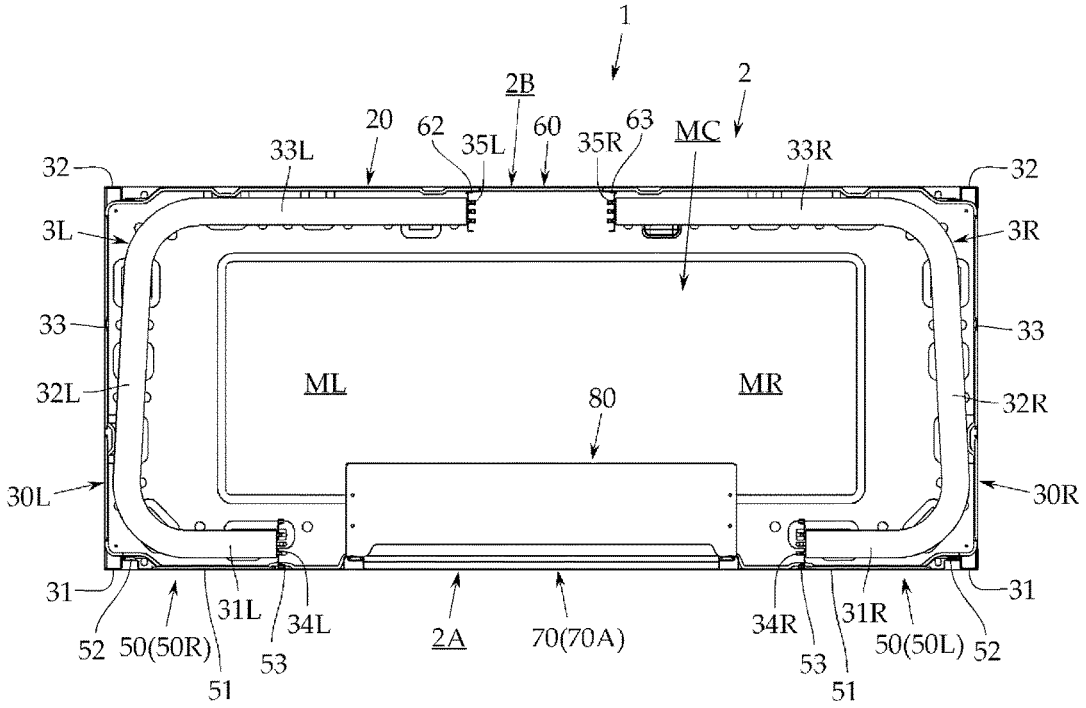
FIG. 3 is a cross-sectional view taken along line A-A of FIG. 1.

Referring to FIG. 3 together, the heat exchanger 3 includes two heat exchanger units of a first heat exchanger 3L and a second heat exchanger 3R. The first heat exchanger 3L includes a left front portion 31L disposed along a left front end of the base panel 20, a left side portion 32L disposed along the left side end of the base panel 20, and a left rear portion 33L disposed along a left rear end of the base panel 20, and is formed in a U-shape in a top view (paper direction in FIG. 3).

The first heat exchanger 3L is fixed to the base panel 20 via a first end plate 34L (hereinafter, also referred to as a front end portion 34L) attached to an end portion of the left front portion 31L, and a second end plate 35L (hereinafter, also referred to as a rear end portion 35L) attached to an end portion of the left rear portion 33L.

The second heat exchanger 3R includes a right front portion 31R disposed along a right front end of the base panel 20, a right side portion 32R disposed along the right side end of the base panel 20, and a right rear portion 33R disposed along a right rear end of the base panel 20, and is formed in a U-shape in a top view (paper direction in FIG. 3).

The second heat exchanger 3R is fixed to the base panel 20 via a third end plate 34R (hereinafter, also referred to as a front end portion 34R) attached to the end portion of the right front portion 31R, and a fourth end plate 35R (hereinafter, also referred to as a rear end portion 35R) attached to the end portion of the right rear portion 33R.

The first heat exchanger 3L is disposed in a U-shape along a front surface-left side surface-rear surface of the housing 2. The second heat exchanger 3R is disposed in a U-shape along a front surface-right side surface-rear surface of the housing 2. The first heat exchanger 3L and the second heat exchanger 3R are symmetrically disposed so that end portions face each other with the center of the housing 2 being interposed therebetween.

Figure 5:
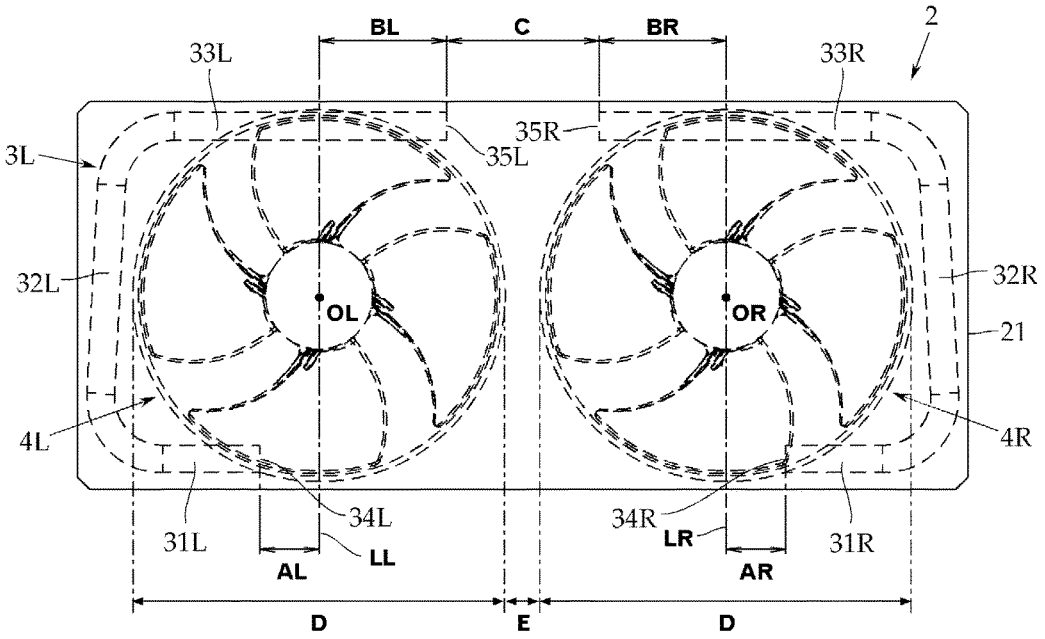
FIG. 5 is a schematic diagram for describing a positional relationship of a heat exchanger and a blower.

Referring to FIG. 5, in the first heat exchanger 3L, the front end portion 34L is disposed closer to the left side panel 30L side than a rotation shaft OL of the first blower 4L, and the rear end portion 35L is disposed closer to the right side panel 30R side than the rotation shaft OL of the first blower 4L. In the second heat exchanger 3R, the front end portion 34R is disposed closer to the right side panel 30R side than a rotation shaft OR of the second blower 4R, and the rear end portion 35R is disposed closer to the left side panel 30L side than the rotation shaft OR of the second blower 4R.

When a first virtual line passing through the axis of the rotation shaft OL of the first blower 4L and orthogonal to the front surface of the housing 2 is defined as LL, a second virtual line passing through the axis of the rotation shaft OR of the second blower 4R and orthogonal to the front surface of the housing 2 is defined as LR, a distance between the first virtual line LL and the rear end portion 35L of the first heat exchanger 3L is defined as BL, a distance between the second virtual line LR and the rear end portion 35R of the second heat exchanger 3R is defined as BR, a distance between the first virtual line LL and the front end portion 34L of the first heat exchanger 3L is defined as AL, and a distance between the second virtual line LR and the front end portion 34R of the second heat exchanger 3R is defined as AR, the distance AL of the front end portion 34L of the first heat exchanger 3L satisfies 0.4×BL or more and 0.5×BL or less (0.4 BL≤AL≤0.5 BL), and the distance AR of the front end portion 34R of the second heat exchanger 3R satisfies 0.4×BR or more and 0.5×BR or less (0.4 BR≤AR≤0.5 BR).

In this manner, the front end portion 34L of the first heat exchanger 3L is disposed closer to the left side than the rotation shaft OL of the first blower 4L, the rear end portion 35L thereof is disposed closer to the right side than the rotation shaft OL of the first blower 4L, the front end portion 34R of the second heat exchanger 3R is disposed closer to the right side than the rotation shaft OR of the second blower 4R, and the rear end portion 35R thereof is disposed closer to the left side than the rotation shaft OR of the second blower 4R. Therefore, the relative arrangement of the heat exchanger and the blower is optimized, and it is possible to effectively utilize the wind of the blower which is conventionally wasted. As a result, since the amount of air and the wind velocity distribution per unit area passing through the heat exchanger at the same rotation speed increase, the rotation speed (current consumption) of the motor for obtaining the same amount of air is reduced.

It is preferable that the distance C between the rear end portion 35L of the first heat exchanger 3L and the rear end portion 35R of the second heat exchanger 3R is made as small as possible. According to this configuration, it is possible to shorten the length in the lateral direction of a rear pillar 60 described later. As a result, it is possible to design the length in the lateral direction of the housing 2 to be short. In the embodiment, the distance C is 300 mm.

Referring back to FIGS. 1 to 4, since basic shapes of the left side panel 30L and the right side panel 30R are the same as each other, and these panels are symmetrically disposed, hereinafter, a configuration of the left side panel 30L will be described.

The left side panel 30L includes a press-formed metal plate, the width thereof is substantially the same as the length of a left end of the base panel 20, and is formed in a vertically elongated rectangular shape extending from a lower end to an upper end of the housing 2.

Figure 2:
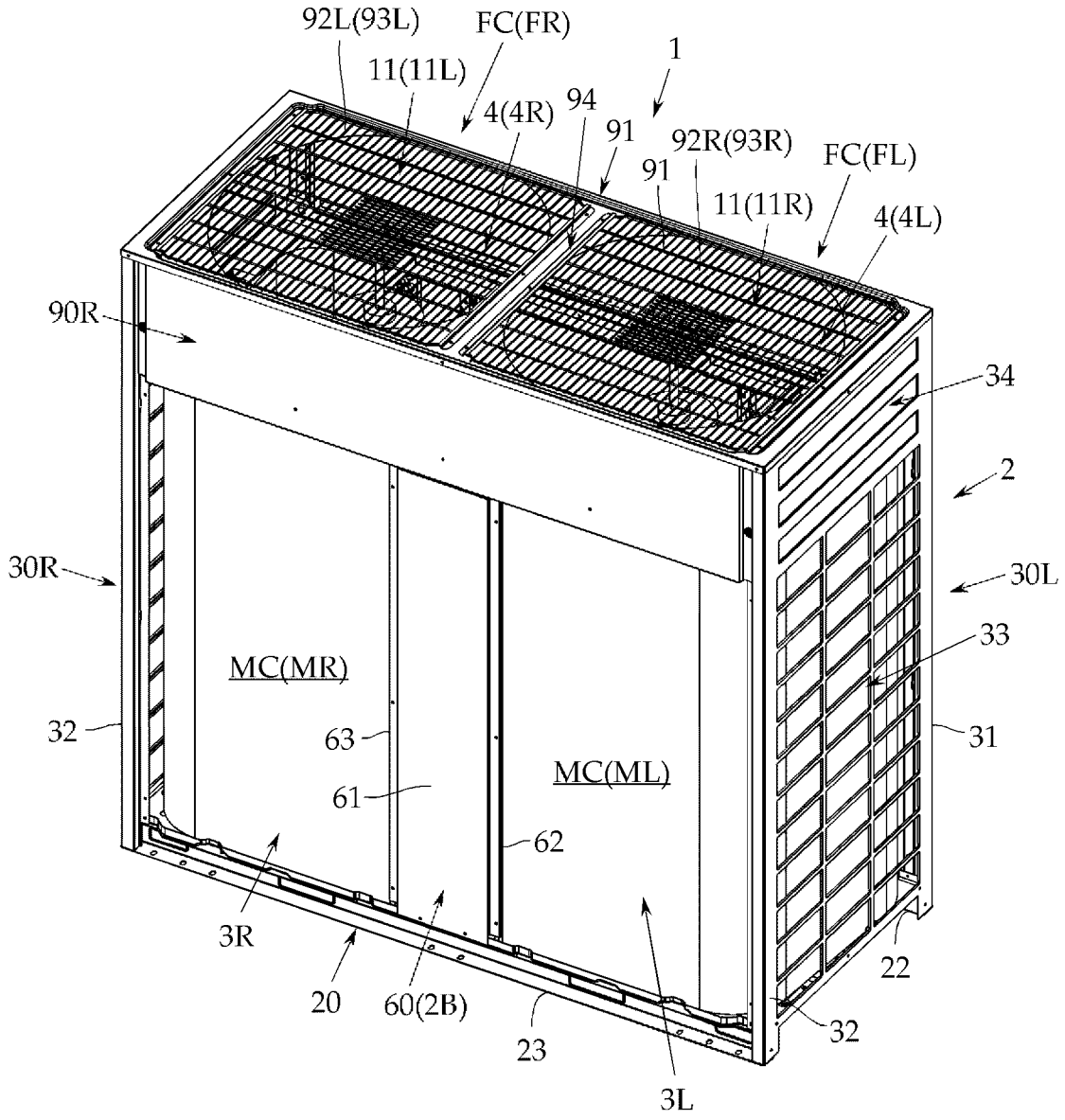
FIG. 2 is an external perspective view of a rear surface side of the outdoor unit of an air conditioner.

The left side panel 30L includes a pair of post portions 31 and 32 that engage with corner portions of the base panel 20, and a grille portion 33 that protects the left side portion 32L of the first heat exchanger 3L, and a panel portion 34 that closes the right side surface of the blower chamber FC in FIG. 2 are formed between the post portions 31 and 32. Since the lower ends of the post portions 31 and 32 are engaged with the side surfaces of the front leg 22 and the rear leg 23 of the base panel 20, the lower ends thereof protrude from the lower end of the left side panel 30L.

In the grille portion 33, a portion extending from the lower end to the upper end of the first heat exchanger 3L is opened in a latticed shape, and the first heat exchanger 3L is adapted to be exposed to the outside via the grille portion 33. The panel portion 34 is a panel surface which closes the right side surface of the blower chamber FC.

Referring to FIG. 4, the front beam 40F includes an angle steel material having an L-shaped cross section in this example, and is horizontally hung between the post portion 31 of the left side panel 30L and the post portion 31 of the right side panel 30R. One end of the front beam 40F is screwed to the post portion 31 on the front end side of the left side panel 30L, and the other end thereof is screwed to the post portion 31 on the front end side of the right side panel 30R.

The rear beam 40R includes an angle steel material similarly having an L-shaped cross section, and is horizontally hung between the post portion 32 of the left side panel 30L and the post portion 32 of the right side panel 30R. One end of the rear beam 40R is screwed to the post portion 32 on the rear end side of the left side panel 30L, and the other end thereof is screwed to the post portion 32 on the rear end side of the right side panel 30R.

In the embodiment, the front beam 40F and the rear beam 40R are disposed along a boundary between the machine chamber MC and the blower chamber FC of the housing 2. The front beam 40F and the rear beam 40R are disposed on the same plane so as to be parallel to each other and parallel to the base panel 20.

Referring to FIG. 4, a first motor bracket 41L that mounts the first blower 4L and a second motor bracket 41R that mounts the second blower 4R are disposed between the front beam 40F and the rear beam 40R. In the embodiment, the first motor bracket 41L is disposed in the left blower chamber FL, and the second motor bracket 41R is disposed in the right blower chamber FR.

Since the first motor bracket 41L and the second motor bracket 41R have the same configuration, hereinafter, the first motor bracket 41L will be described. The first motor bracket 41L includes a pair of beam members 411 and 411 hung in parallel between the front beam 40F and the rear beam 40R, and both ends of the beam members 411 and 411 are respectively screwed and fixed to the front beam 40F and the rear beam 40R.

A fan motor M of the blower 4L is mounted on the first motor bracket 41L, and a blower fan (not illustrated) is attached to a rotation shaft of the fan motor M. Although a bell mouth (not illustrated) is provided on an outer circumference of the blower fan, a description thereof will be omitted.

Referring to FIG. 5, both of the first air blowing port 11L of the first blower 4L and the second air blowing port 11R of the second blower 4R have the same diameter D (diameter D=710 mm in this example), and are disposed so as to be symmetrical each other with a predetermined interval E (interval E=90 mm in this example) with the center of the housing 2 being interposed therebetween.

A cylindrical bell mouth BM (BML and BMR, refer to FIG. 5) is disposed on an outer circumference of each of the blowers 4 (4L and 4R). In the embodiment, the air blowing ports 11 (11L and 11R) correspond to the inner diameter (φ 1 in FIG. 5) of the bell mouth BM. In FIG. 5, the position of the outline of the bell mouth BM is illustrated by a dashed line.

In the embodiment, the bell mouth BM is formed so that the opening diameter of the air blowing port 11 gradually decreases as going from the lower end (lower end in FIG. 5) to the upper end (upper end in FIG. 5) in the axial direction. According to this configuration, as the blower 4 is driven, the air that is passed through the heat exchangers 3L and 3R from the outside surface of the housing 2 and is heat-exchanged is discharged from the air blowing port 11 to the outside of the housing 2 via the blower 4.

Additionally, since two blowers 4L and 4R are mounted on the front beam 40F and the rear beam 40R, the bending moment increases from the both ends toward the center to the front beam 40F and the rear beam 40R, and there is a possibility of distortion or bending to occur in the front beam 40F and the rear beam 40R.

Therefore, in order to increase mechanical strength of the front beam 40F and the rear beam 40R, a front pillar 50 and a rear pillar 60 are disposed in the housing 2. The front pillar 50 is provided with a left front pillar 50L disposed at a front surface side of the left machine chamber ML, and a right front pillar 50R disposed at a front surface side of the right machine chamber MR.

Next, although a configuration of each of the front pillars 50L and 50R is described, since the basic configurations of the front pillars 50L and 50R are the same as each other, and have a symmetrical shape, the left front pillar 50L will be described.

The left front pillar 50L includes, for example, a single press-formed steel plate, and is formed in a vertically elongated rectangular shape. The left front pillar 50L is provided with the grille portion 51 that protects the left front portion 31L of the first heat exchanger 3L. In the embodiment, the grille portion 51 is formed in a latticed shape in which eight through holes 511 cut out squarely are disposed.

A first flange portion 52 for screwing the left front pillar 50L to the post portion 31 of the left side panel 30L is disposed at the left end of the left front pillar 50L. A second flange portion 53 to which service panels 70A and 70B and an electric component box 80 described later are attached is disposed at a right end of the left front pillar 50L. A third flange portion 54 for screwing to the front beam 40F is further disposed on the upper end of the left front pillar 50L.

A lower end side of the left front pillar 50L is screwed to the base panel 20, and the upper end side of the left front pillar 50L is screwed to the front beam 40F via the third flange portion 54, and the left front pillar 50L is further screwed in a state where the first flange portion 52 abuts on the post portion 31 of the left side panel 40L.

As illustrated in FIG. 2, the rear pillar 60 includes, for example, a press-formed steel plate, and is formed in a vertically elongated rectangular shape in which the lower end thereof is fixed to the base panel 20, and the upper end thereof is fixed to the rear beam 40R.

The rear pillar 60 is provided with a panel body 61 on the center, that closes a rear opening portion 2B existing between the first heat exchanger 3L and the second heat exchanger 3R. The first flange portion 62 screwed to an end plate 35L of the first heat exchanger 3L is formed at the right end of the rear pillar 60 in FIG. 2, and the second flange portion 63 screwed to the endplate 35R of the second heat exchanger 3R is formed at the left end of the rear pillar 60 in FIG. 2. The upper end of the rear pillar 60 is screwed to the rear beam 40R.

In the rear pillar 60, the lower end is screwed to the base panel 20, and the upper end is screwed to the rear beam 40R, and the first flange portion 62 is screwed to the end plate 35L of the first heat exchanger 3L, and the second flange portion 63 is screwed to the end plate 35R of the second heat exchanger 3R. According to this configuration, as illustrated in FIG. 2, it is possible to close the rear opening portion 2B existing between the first heat exchanger 3L and the second heat exchanger 3R with the rear pillar 60.

According to this configuration, the two front pillars 50L and 50R are screwed between the base panel 20 and the front beam 40F and the rear pillar 60 is locked between the base panel 20 and the rear beam 40R. Therefore, the mechanical strength of the housing 2 is increased, and deformation and bending of the housing 2 can be prevented.

Although protection grilles (not illustrated) for protecting rear portions 33L and 33R of the first and second heat exchangers 3L and 3R are screwed between the rear pillar 60 and the right and left side panels 50R and 50L, since a description is particularly not required in the present invention, the description thereof will be omitted.

Referring to FIGS. 1 to 4, the space between the left front pillar 50L and the right front pillar 50R of the housing 2 is a front opening portion 2A (refer to FIG. 4) for maintenance. Accordingly, the service panel 70 is attached to the front opening portion 2A.

The service panel 70 includes two panel materials having an upper service panel 70A that closes an upper side of the front opening portion 2A, and a lower service panel 70B that closes a lower side of the front opening portion 2A.

The upper service panel 70A and the lower service panel 70B include substantially square metal panels. The left end of the upper service panel 70A and the lower service panel 70B (left end in FIG. 1) is screwed to the second flange portion 53 of the left front pillar 50L. The right end of the upper service panel 70A and the lower service panel 70B (right end in FIG. 1) is screwed to the second flange portion 53 of the right front pillar 50R.

In the embodiment, the lower left corner of the lower service panel 70B is cut in an L-shape, and a conduit panel 74 for connecting a conduit pipe (not illustrated) is fitted into a cutout portion 73 thereof.

As illustrated in FIG. 3, the electric component box 80 is disposed on a rear surface (surface facing the inside of the housing 2) of the upper service panel 70A. The electrical component box 80 includes a rectangular parallelepiped box substantially equal in size to the upper service panel 70A and is screwed to the second flange portions 53 and 53 of the right and left front pillars 50R and 50L.

The front panel 90F is disposed at a front surface side (front surface side in FIG. 1) of the blower chamber FC, and a rear panel 90R is disposed at a rear surface side (front surface side in FIG. 2) of the blower chamber FC of the housing 2. Both the front panel 90F and the rear panel 90R are horizontally elongated rectangular metal panels covering the front surface side and the rear surface side of the blower chamber FC, and are respectively screwed to the side panels 30L and 30R.

A top panel 91 is attached to a top surface of the blower chamber FC. A top panel 91 includes a horizontally elongated rectangular metal frame covering the upper surface of the housing 2, and a rectangular first opening portion 92L exposing the first air blowing port 11L and a square second opening portion 92R exposing the second air blowing port 11R are formed. In the embodiment, reinforcing beam portions 94 are formed between each of the opening portions 92L and 92R, and the protection grilles 93R and 93L are respectively screwed to each of the right and left opening portions 92R and 92L with the beam portion 94 interposed therebetween.

As described above, according to the present invention, the front end portion of the first heat exchanger is disposed closer to the left side than the rotation shaft of the first blower, the rear end portion thereof is disposed closer to the right side than the rotation shaft of the first blower, and the front end portion of the second heat exchanger is disposed closer to the right side than the rotation shaft of the second blower and the rear end portion thereof is disposed closer to the left side than the rotation shaft of the second blower. Therefore, the relative arrangement of the heat exchanger and the blower is optimized, and it is possible to effectively utilize the wind of the blower which is conventionally wasted. As a result, since the amount of air and the wind velocity distribution per unit area passing through the heat exchanger at the same rotation speed increase, the rotation speed (current consumption) of the motor for obtaining the same amount of air is reduced.

What is claimed is:

1. An outdoor unit of an air conditioner comprising:

a housing that includes a base panel, a left side panel that is vertically disposed at a left side end of the base panel, a right side panel that is vertically disposed at a right side end of the base panel, and a front beam and a rear beam that are respectively hung between front ends of the left side panel and the right side panel and between rear ends of the left side panel and the right side panel, an interior of the housing being partitioned into a machine chamber at a lower portion and a blower chamber at an upper portion, with a plane including the front beam and the rear beam as a boundary, the machine chamber having a left machine chamber and a right machine chamber, and the blower chamber having a left blower chamber and a right blower chamber;

a first blower and a second blower that are supported side by side on the front beam and the rear beam, the first blower being disposed in the left blower chamber, and the second blower being disposed in the right blower chamber;

a first heat exchanger and a second heat exchanger, each including a front portion having a front end portion and disposed along a front surface of the base panel, a rear portion having a rear end portion and disposed along a rear surface of the base panel, and a side portion disposed along one of the left side panel and the right side panel of the base panel between the front portion and the rear portion to be formed in a U-shape, the first heat exchanger being disposed in the left machine chamber and the second heat exchanger being disposed in the right machine chamber such that the front end portions thereof face each other, and the rear end portions face each other; and a first air blowing port that is disposed above the first blower and a second air blowing port that is disposed above the second blower, on a top surface of the housing, wherein in the first heat exchanger, the front end portion of the front portion is disposed closer to the left side panel than a rotation shaft of the first blower, and the rear end portion of the rear portion is disposed closer to the right side panel than the rotation shaft of the first blower, and in the second heat exchanger, the front end portion of the front portion is disposed closer to the right side panel than a rotation shaft of the second blower, and the rear end portion of the rear portion is disposed closer to the left side panel than the rotation shaft of the second blower; and when a first virtual line passing through an axis of the rotation shaft of the first blower and orthogonal to the front surface of the base panel is defined as LL, a second virtual line passing through an axis of the rotation shaft of the second blower and orthogonal to the front surface of the base panel is defined as LR, a distance between the first virtual line LL and the rear end portion of the first heat exchanger is defined as BL, a distance between the second virtual line LR and the rear end portion of the second heat exchanger is defined as BR, a distance between the first virtual line LL and the front end portion of the first heat exchanger is defined as AL, and a distance between the second virtual line LR and the front end portion of the second heat exchanger is defined as AR, and the distance AL of the front end portion of the first heat exchanger satisfies 0.4×BL or more and 0.5×BL or less, and the distance AR of the front end portion of the second heat exchanger satisfies 0.4×BR or more and 0.5×BR or less.

2. The outdoor unit of an air conditioner according to claim 1, wherein the first heat exchanger and the second heat exchanger are symmetrically disposed with a center of the housing being interposed therebetween.

3. The outdoor unit of an air conditioner according to claim 1, wherein the first blower and the second blower are symmetrically disposed with a center of the housing being interposed therebetween.

4. The outdoor unit of an air conditioner according to claim 1, wherein the front portion of the first heat exchanger horizontally extends in a direction toward the second heat exchanger from one end of the side portion of the first heat exchanger, and the rear portion of the first heat exchanger horizontally extends in the direction toward the second heat exchanger same as that of the front portion of the first heat exchanger from another end of the side portion of the first heat exchanger; and the rear portion of the first heat exchanger has a length in the direction toward the second heat exchanger longer than that of the front portion thereof; and the front portion of the second heat exchanger horizontally extends in a direction toward the first heat exchanger from one end of the side portion of the second heat exchanger, and the rear portion of the second heat exchanger horizontally extends in the direction toward the first heat exchanger same as that of the front portion of the second heat exchanger from another end of the side portion of the second heat exchanger; and the rear portion of the second heat exchanger has a length in the direction toward the first heat exchanger longer than that of the front portion thereof.

5. An outdoor unit of an air conditioner comprising:

a housing that includes a base panel, a left side panel that is vertically disposed at a left side end of the base panel, a right side panel that is vertically disposed at a right side end of the base panel, and a front beam and a rear beam that are respectively hung between front ends of the left side panel and the right side panel and between rear ends of the left side panel and the right side panel, an interior of the housing being partitioned into a machine chamber at a lower portion and a blower chamber at an upper portion, with a plane including the front beam and the rear beam as a boundary, the machine chamber having a left machine chamber and a right machine chamber, and the blower chamber having a left blower chamber and a right blower chamber;

a first blower and a second blower that are supported side by side on the front beam and the rear beam, the first blower being disposed in the left blower chamber, and the second blower being disposed in the right blower chamber;

a first heat exchanger and a second heat exchanger, each including a front portion having a front end portion and disposed along a front surface of the base panel, a rear portion having a rear end portion and disposed along a rear surface of the base panel, and a side portion disposed along one of the left side panel and the right side panel of the base panel between the front portion and the rear portion to be formed in a U-shape, the first heat exchanger being disposed in the left machine chamber and the second heat exchanger being disposed in the right machine chamber such that the front end portions thereof face each other, and the rear end portions face each other; and a first air blowing port that is disposed above the first blower and a second air blowing port that is disposed above the second blower, on a top surface of the housing, wherein in the first heat exchanger, the front end portion of the front portion is disposed closer to the left side panel than a rotation shaft of the first blower, and the rear end portion of the rear portion is disposed closer to the right side panel than the rotation shaft of the first blower, and in the second heat exchanger, the front end portion of the front portion is disposed closer to the right side panel than a rotation shaft of the second blower, and the rear end portion of the rear portion is disposed closer to the left side panel than the rotation shaft of the second blower;

the front portion of the first heat exchanger horizontally extends in a direction toward the second heat exchanger from one end of the side portion of the first heat exchanger, and the rear portion of the first heat exchanger horizontally extends in the direction toward the second heat exchanger same as that of the front portion of the first heat exchanger from another end of the side portion of the first heat exchanger; and the rear portion of the first heat exchanger has a length in the direction toward the second heat exchanger longer than that of the front portion thereof, and the front portion of the second heat exchanger horizontally extends in a direction toward the first heat exchanger from one end of the side portion of the second heat exchanger, and the rear portion of the second heat exchanger horizontally extends in the direction toward the first heat exchanger same as that of the front portion of the second heat exchanger from another end of the side portion of the second heat exchanger; and the rear portion of the second heat exchanger has a length in the direction toward the first heat exchanger longer than that of the front portion thereof; and a distance between the front end portion of the first heat exchanger and an axis of the rotation shaft of the first blower in a horizontal direction of the housing is shorter than a half of a diameter of the first blower, and a distance between the front end portion of the second heat exchanger and an axis of the rotation shaft of the second blower in the horizontal direction of the housing is shorter than a half of a diameter of the second blower, and a distance between the rear end portion of the first heat exchanger and the axis of the rotation shaft of the first blower in the horizontal direction of the housing is shorter than the half of the diameter of the first blower, and a distance between the rear end portion of the second heat exchanger and the axis of the rotation shaft of the second blower in the horizontal direction of the housing is shorter than the half of the diameter of the second blower.

* * * * *